US005791978A

United States Patent [19]

Cesna et al.

[11] Patent Number: 5,791,978

[45] Date of Patent: Aug. 11, 1998

[54] BEARING ASSEMBLY FOR WAFER PLANARIZATION CARRIER

[75] Inventors: Joseph V. Cesna, Niles, Ill.; Gordon J. Grosslight, Westcliffe, Colo.; Chris Karlsrud, Chandler, Ariz.

[73] Assignee: Speedfam Corporation, Chandler, Ariz.

[21] Appl. No.: 751,014

[22] Filed: Nov. 14, 1996

[51] Int. Cl.[6] ..... B24B 7/04; B24B 29/00

[52] U.S. Cl. ..... 451/388; 451/288; 451/289; 451/398; 279/3

[58] Field of Search ..... 279/3; 451/41, 451/285, 286, 287, 288, 289, 388, 397, 398; 269/21

[56] References Cited

U.S. PATENT DOCUMENTS

| | | | |
|---|---|---|---|
| 3,579,917 | 5/1971 | Boettcher et al. | 451/288 |
| 3,731,435 | 5/1973 | Boettcher et al. | 451/288 |
| 4,194,324 | 3/1980 | Bonora et al. | 451/289 |
| 4,270,314 | 6/1981 | Cesna . | |
| 5,423,558 | 6/1995 | Koeth et al. | 451/289 X |
| 5,476,414 | 12/1995 | Hirose et al. | 451/288 |
| 5,551,307 | 9/1996 | Kane et al. . | |
| 5,584,751 | 12/1996 | Kobayashi et al. | 451/288 |
| 5,624,299 | 4/1997 | Shendon | 451/288 X |

FOREIGN PATENT DOCUMENTS

| | | | |
|---|---|---|---|
| 63-62668 | 3/1988 | Japan | 451/288 |

*Primary Examiner*—Timothy V. Eley
*Attorney, Agent, or Firm*—Snell & Wilmer

[57] ABSTRACT

An apparatus for engaging a workpiece against a polishing surface in a first embodiment includes a lower plate member, the lower plate member includes a hub on a top surface. An upper plate member includes a seat disposed on a bottom surface. The hub fits within the seat to form an air bearing between the lower and upper plate members. A structure supplies air to the air bearing and a flexure spring is disposed between the upper and lower plate members. The lower plate member includes vacuum holes in its bottom surface which are connected to a vacuum source which creates a vacuum pressure for holding the workpiece against the lower plate. A retainer ring including a flange is positioned about the outer edge surface of the lower plate member for holding the workpiece in place on the bottom surface of the lower plate member. A detachable pressure plate is connected to the lower plate member by at least one quick release apparatus which utilizes a locking pin secured to the pressure plate and configured to fit through a bore in the lower plate member. In a second embodiment, the upper plate member has recesses in its top and bottom surfaces. The lower plate member includes recesses in its top surface which are aligned with the upper plate member. A plurality of springs held by connecting pins are disposed in the recesses, and a flexure spring is disposed between the upper and lower plate members.

15 Claims, 7 Drawing Sheets

BEARING ASSEMBLY FOR WAFER PLANARIZATION CARRIER

TECHNICAL FIELD

The present invention relates, generally, to machines for polishing or planarizing workpieces such as semiconductor wafers. More particularly, the present invention relates to a device which supports and engages a workpiece against a polishing pad surface.

BACKGROUND ART AND TECHNICAL PROBLEMS

Many electronic and computer-related products such as semiconductors, CD-ROMs, and computer hard disks, require highly polished surfaces in order to achieve optimum operational characteristics. For example, high-quality and extremely precise wafer surfaces are often needed during the production of semiconductor-based integrated circuits. During the fabrication process, the wafers generally undergo multiple masking, etching, and dielectric and conductor deposition processes. Because of the high-precision required in the production of these integrated circuits, an extremely flat surface is generally needed on at least one side of the semiconductor wafer to ensure proper accuracy and performance of the microelectronic structures created on the wafer surface. As the size of integrated circuits decreases and the density of microstructures on integrated circuits increases, so too must the accuracy and precision of the wafer surface polishing also increase. For a discussion of polishing and chemical mechanical planarization (CMP) processes and apparatus for semiconductor wafers, see, for example, Arai, et al., U.S. Pat. No. 4,805,348, issued February, 1989; Arai, et al., U.S. Pat. No. 5,099,614, issued March, 1992; Karlsrud et al., U.S. Pat. No. 5,329,732, issued July, 1994; Karlsrud, U.S. Pat. No. 5,498,196, issued March, 1996; and Karlsrud et al., U.S. Pat. No. 5,498,199, issued March, 1996.

Such workpiece polishing is well known in the art and generally involves attaching one side of the wafer to a flat surface of a wafer carrier or chuck and pressing the other side of the wafer against a flat polishing surface. In general, the polishing surface includes a horizontal polishing pad that has an exposed abrasive surface of cerium oxide, aluminum oxide, fumed/precipitated silica, or other particulate abrasives. Commercially available polishing pads may utilize various materials, as is known in the art. Typically, polishing pads may be formed from a blown polyurethane, such as the IC and GS series of polishing pads available from Rodel Products Corporation in Scottsdale, Arizona. The hardness and density of the polishing pad depends on the material that is to be polished and the degree of precision required in the polishing process.

During the polishing or planarization process, the workpiece (e.g., wafer) is typically pressed against the polishing pad surface while the pad rotates about its vertical axis. To improve polishing effectiveness, the wafer may also be rotated about its vertical axis and oscillated back and forth over the surface of the polishing pad. It is well known that polishing pads tend to wear unevenly during the polishing operation, causing surface irregularities to develop on the pad. These irregularities can cause a cant pressure to accumulate between the bottom plate of the carrier and the polishing surface as the carrier rotates and oscillates. Further, a canting pressure can be caused by a slight lateral deflection or wobble of the carrier shaft, or by a differential drag occurring between the polishing surface and the workpiece confined beneath the carrier as the polishing operation progresses. More particularly, during the polishing process, the carrier assembly exerts an axial downward force on the bottom pressure plate of the carrier. The downward force applied by the carrier to the workpiece is generally dictated by many factors including, for example, the size or durability of the workpiece and the speed of the polishing or lapping; the downward force can range between several hundred and several thousand pounds. Thus as the bottom of the carrier plate cants, the axial downward force may not be uniform across the entire workpiece, resulting in a non-uniform polish or lap.

Accordingly, the carrier element should be designed and configured to apply a uniform pressure on the workpiece, yet compensate for these canting pressures. Various carrier assemblies with different bearing or gimbal designs are currently known in the art. For example, Cesna, U.S. Pat. No. 4,270,314, issued on Jun. 2, 1981, and Hirose, et al., U.S. Pat. No. 5,476,414, issued on Dec. 19, 1995 disclose carrier elements having a bearing assemblies that allow the bottom pressure plate of the carrier to freely rotate and swivel, yet still apply the proper downward axial force on the workpiece. However, presently known carrier assemblies still have relatively high gimbal points which prevent the carriers from applying truly uniform pressures on the workpieces when undesirable lateral canting pressures occur. Because the carrier assemblies currently known in the art do not adequately compensate for the canting pressures, the following problems may arise: edge polishing of the workpiece, pressure plate distortion from flexing under the axial and canting pressure loads, assembly bolt distortion, and gimbal bearing binding and failures.

Therefore, an improved carrier assembly and, in particular, an improved bearing or gimbal design is needed to address the above and other limitations of the prior art.

SUMMARY OF THE INVENTION

The present invention provides methods and apparatus for supporting and engaging workpieces against a polishing surface which overcome many of the shortcomings of the prior art.

In accordance with one aspect of the present invention, a workpiece supporting and engaging apparatus includes a lower plate member for securely holding a workpiece during a polishing process. The lower plate member includes a hub disposed on a top planar surface of the lower plate member. The apparatus further includes an upper plate member connected to a drive shaft. The upper plate member includes a seat disposed on the bottom planar surface of the upper plate. The hub of the lower plate member is configured to fit within the seat of the upper plate member such that an air bearing is formed between the lower plate member and the upper plate member. The apparatus further includes a structure for supplying air to the air bearing and a flexure spring disposed between and connected to the upper and lower plate members.

In accordance with another embodiment of the present invention, the lower plate member of the workpiece engaging apparatus further includes a plurality of vacuum holes formed in its bottom planer surface. The vacuum holes are connected to a vacuum source which creates a vacuum pressure for holding the workpiece against the lower plate.

In accordance with yet another aspect of the present invention, a retainer ring is positioned about the outer edge surface of the lower plate member. The retainer ring includes a flange which extends to the bottom planer surface of the lower plate for holding the workpiece in place on the bottom planar surface of the lower plate.

In accordance with yet another aspect of the present invention, the lower plate member further includes a detachable pressure plate. In accordance with this aspect of the present invention, a plurality of vacuum holes are formed in the bottom planer surface of the pressure plate. The vacuum holes are connected to a vacuum source which applies a vacuum pressure to the workpiece, holding the workpiece against the pressure plate. Moreover, a retainer ring may be positioned about the outer edge surface of the pressure plate to further hold the workpiece in place on the pressure plate.

In accordance with a further aspect of the present invention, the detachable pressure plate is connected to the lower plate member by at least one quick release apparatus. The quick release apparatus utilizes a locking pin secured to the pressure plate and configured to fit through a bore in the lower plate member. The quick release apparatus further includes a locking bar slidably attached to the upper planer surface of the lower plate member and configured to securely engage the locking pin. Connected to the locking bar is a structure for moving the locking bar into and out of engagement with the locking pin.

In accordance with yet a further aspect of the present invention, a second embodiment of an apparatus for engaging the workpiece against a polishing surface is disclosed. The second embodiment includes an upper plate member connected to a drive shaft. The upper plate member has a plurality of first recesses in its top planar surface and a plurality of second recesses in its bottom surface. The first and second recesses are axially aligned within the upper plate member. The second embodiment further employs a lower plate member configured to securely hold the workpiece during the polishing process. The lower plate member includes a plurality of third recesses in its top planar surface, which are axially aligned with the first and second recesses of the upper plate member. A plurality of first springs are disposed within the first recesses in the upper plate member, and a plurality of second springs are disposed between the upper plate member and the lower plate member within the second and third recesses. Connecting pins hold the first and second springs within the respective recesses. Finally, the apparatus includes a flexure spring disposed between and connected to the upper and lower plate members. In accordance with a preferred embodiment, the apparatus includes six first and second springs disposed within six first, second and third recesses.

BRIEF DESCRIPTION OF THE DRAWING FIGURES

The present invention will hereinafter be described in conjunction with the appended drawing figures, wherein like numerals denote like elements, and:

DETAILED DESCRIPTION OF A PREFERRED EXEMPLARY EMBODIMENT

The subject invention relates to an improved apparatus for supporting and engaging workpieces against a polishing surface. While this invention may be used to polish a large variety of workpieces, the preferred exemplary embodiments discussed herein relate to polishing apparatuses used to polish semiconductor wafers. It will be understood, however, that the invention is not limited to any particular workpiece polishing apparatus.

Figure 1:
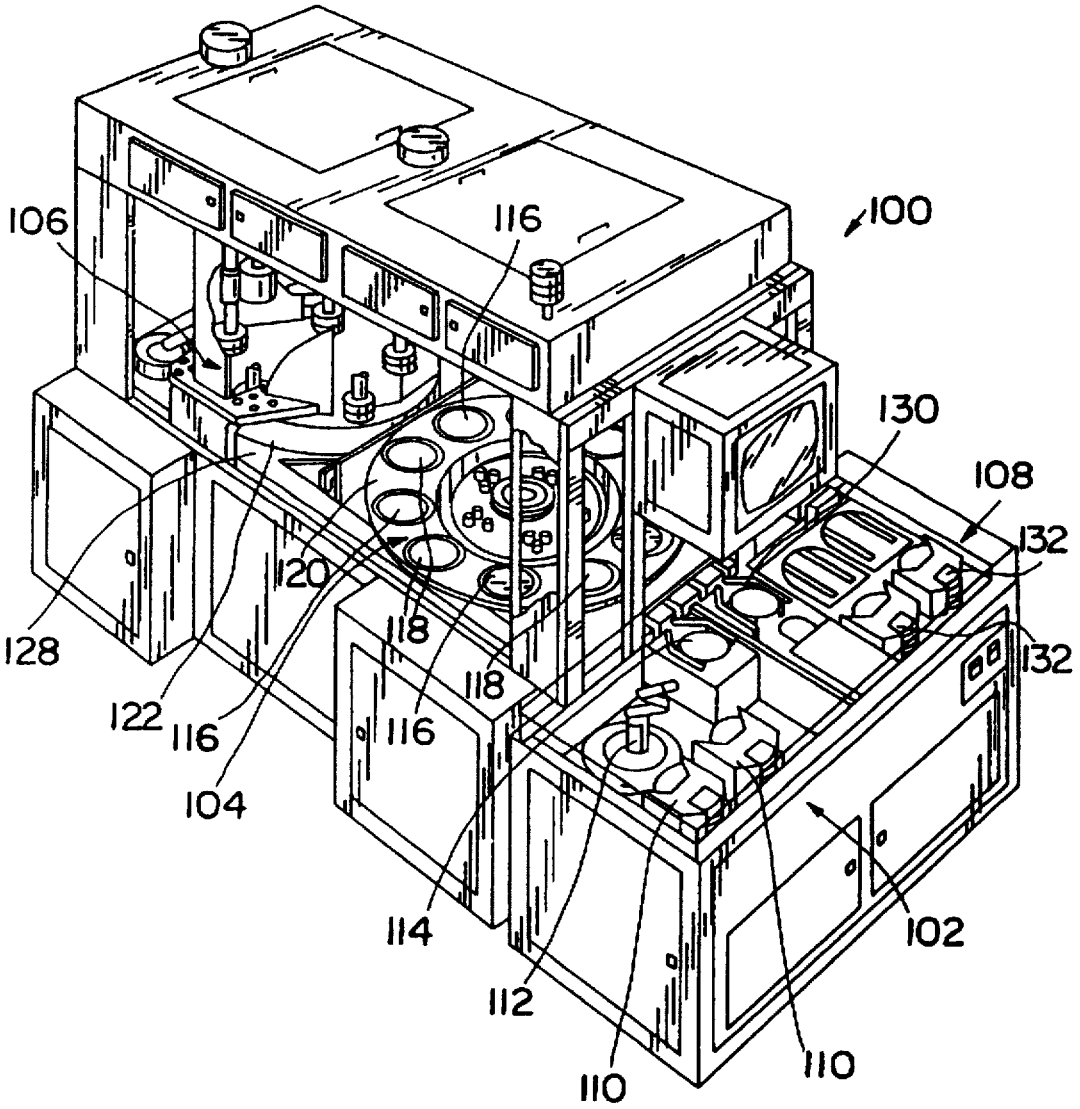
FIG. 1 is a perspective schematic view of an exemplary semiconductor wafer polishing and planarization machine in which the present invention may be employed.
Figure 2:
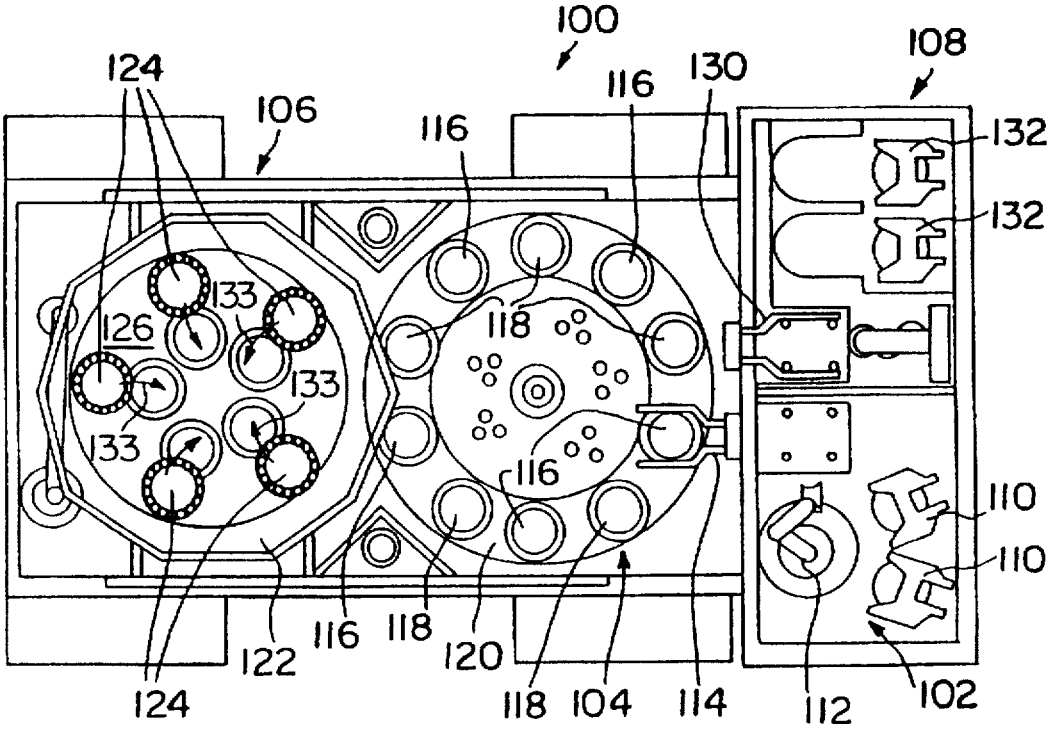
FIG. 2 is a top cross-sectional view of the wafer polishing and planarization machine shown in FIG. 1 illustrating different parts of the machine at different times in the polishing and planarization process.
Figure 3:
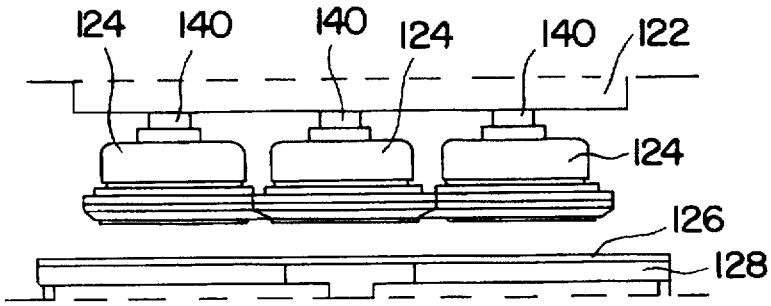
FIG. 3 is a side elevation view of semiconductor wafer carrier elements positioned over a lap wheel polishing pad assembly.

Referring now to FIGS. 1–3, a wafer polishing apparatus 100 is shown embodying the present invention. Wafer polishing apparatus 100 suitably includes a multiple head wafer polishing machine which accepts wafers from a previous processing step, polishes and rinses the wafers, and reloads the wafers back into wafer cassettes for subsequent processing. Apparatus 100 generally includes a wafer load station 102, a wafer transition station 104, a polishing station 106, and a wafer rinse and wafer unload station 108.

In accordance with a preferred embodiment of the invention, cassettes 110, each holding a plurality of wafers, are loaded into the machine at wafer load station 102. Next, a robotic wafer carrier arm 112 removes the wafers from cassettes 110 and places them, one at a time, on a first wafer transfer arm 114. Wafer transfer arm 114 sequentially then lifts and moves each wafer into wafer transition section 104. That is, transfer arm 114 suitably places an individual wafer on one of a plurality of wafer pick-up stations 116 which reside on a rotatable table 120 within wafer transition section 104. Rotatable table 120 also suitably includes a plurality of wafer drop-off stations 118 which alternate with pick-up stations 116. After a wafer is deposited on one of the plurality of pick-up stations 116, table 120 rotates so that a new station 116 aligns with transfer arm 114. Transfer arm 114 then places the next wafer on the new empty pick-up station 116. This process continues until all pick-up stations 116 are filled with wafers. In the illustrated embodiment of the invention, table 120 includes five pick-up stations 116 and five drop-off stations 118.

Next, a wafer carrier apparatus 122, having individual wafer carrier elements 124, suitably aligns itself over table 120 so that respective carrier elements 124 are positioned directly above the wafers which reside in respective pick-up stations 116. The carrier apparatus 122 then drops down and picks up the wafers from their respective stations and moves the wafers laterally such that the wafers are positioned above polishing station 106. Once above polishing station 106, carrier apparatus 122 suitably lowers the wafers, which are held by individual elements 124, into operative engagement with a polishing pad 126 which sits atop a lap wheel 128. During operation, lap wheel 128 causes polishing pad 126 to rotate about its vertical axis. At the same time, individual carrier elements 124 spin the wafers about their respective vertical axes and oscillate the wafers back and forth across pad 126 (substantially along arrow 133) as they press against the polishing pad. In this manner, the under surface of the wafer is polished or planarized.

After an appropriate period of time, the wafers are removed from polishing pad 126, and carrier apparatus 122 transports the wafers back to transition station 104. Carrier apparatus 122 then lowers individual carrier elements 124 and deposits the wafers onto drop-off stations 118. The wafers are then removed from drop-off stations 118 by a second transfer arm 130. Transfer arm 130 suitably lifts each wafer out of transition station 104 and transfers them into wafer rinse and unload station 108. After a thorough rinsing, the wafers are reloaded into cassettes 132, which then transport the subsequent stations for further processing or packaging.

Figure 4:
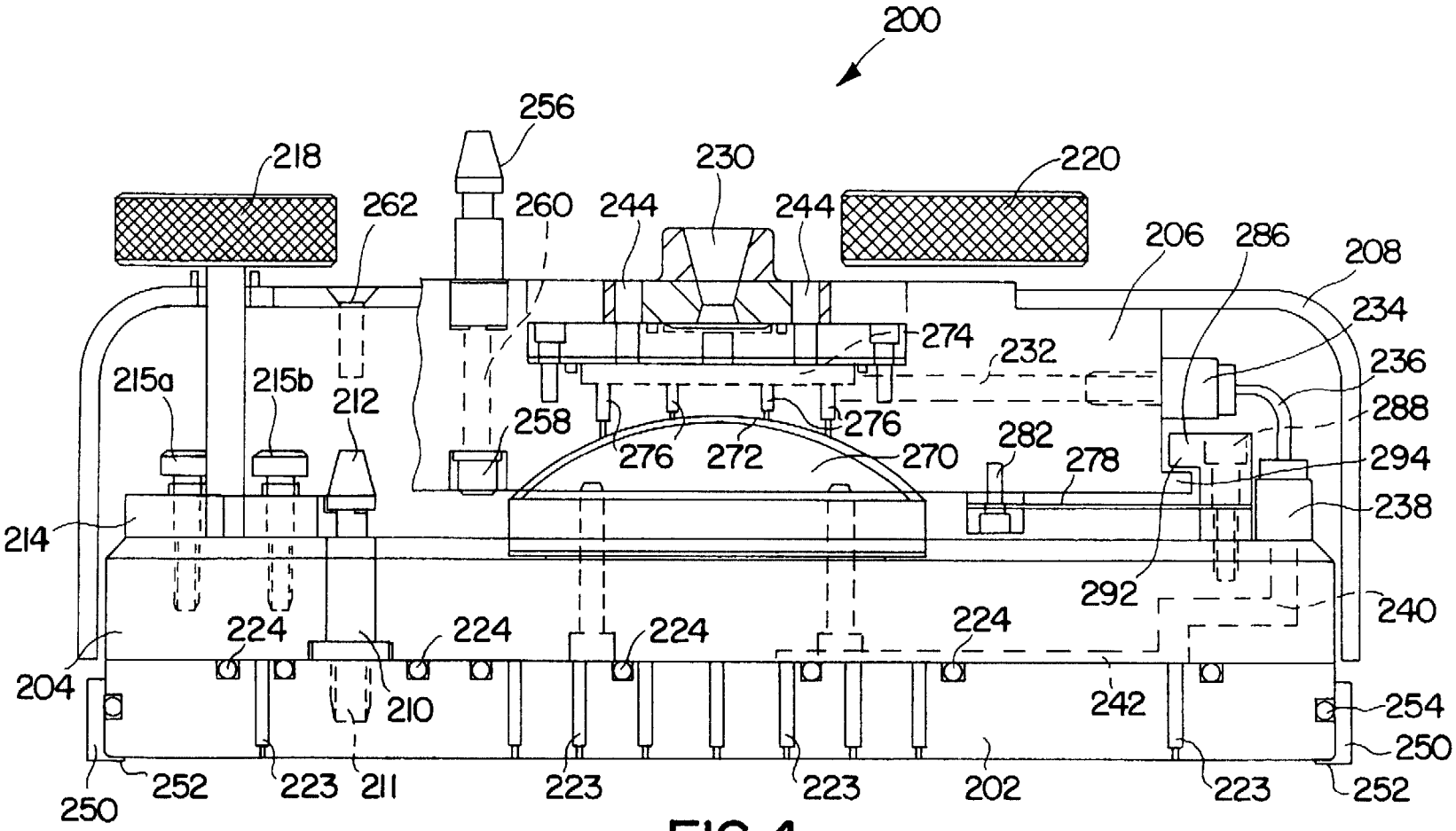
FIG. 4 is a side cut-away view of one of the semiconductor wafer carrier elements shown in FIG. 3 having an air bearing assembly.
Figure 6:
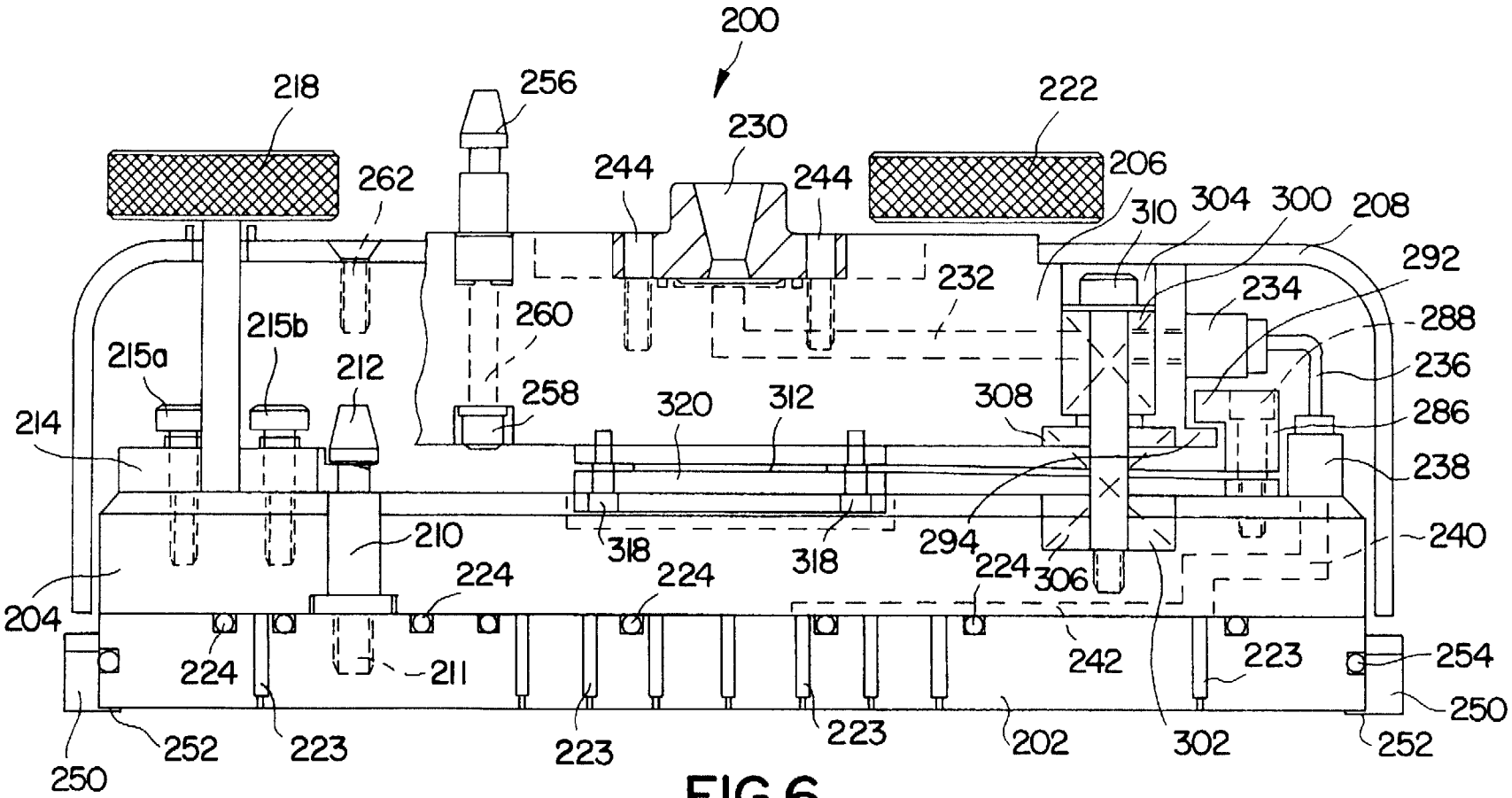
FIG. 6 is a side cut-away view of one of the semiconductor wafer carrier elements shown in FIG. 3 having a pre-loaded spring bearing.

Referring now to FIGS. 4 and 6, exemplary embodiments of an improved wafer carrier element 200 will now be discussed. In accordance with the preferred embodiment of the invention, carrier element 200 suitably employs a pressure plate 202, a lower bearing plate 204, an upper bearing plate 206, and a housing 208.

Figure 8:
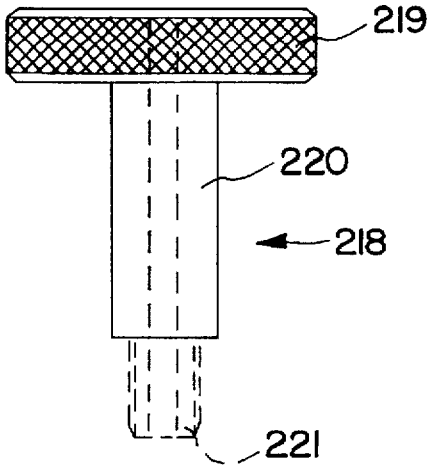
FIG. 8 is a side view of a quick release bolt used on the preferred carrier elements of FIGS. 4 and 6.
Figure 9:
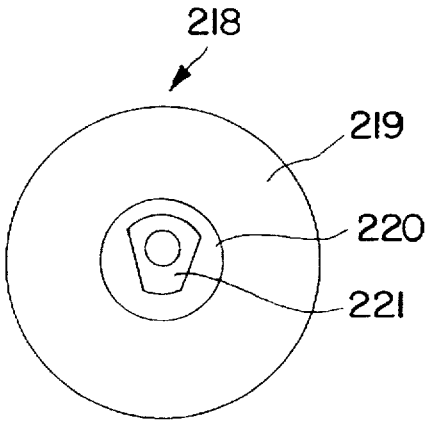
FIG. 9 is a bottom view of the quick release bolt of FIG. 8.
Figure 10:
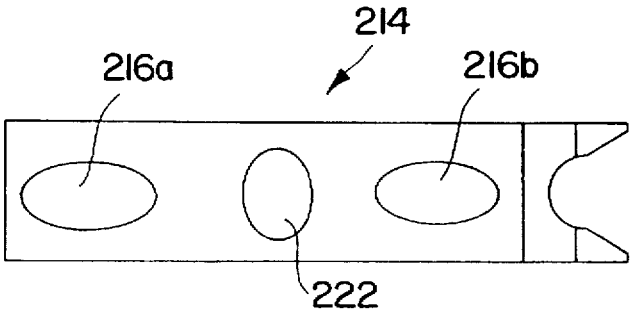
FIG. 10 is a top view of a slidable quick release bar which is part of the quick release assembly of the wafer carrier elements shown in FIGS. 4 and 6.
Figure 11:
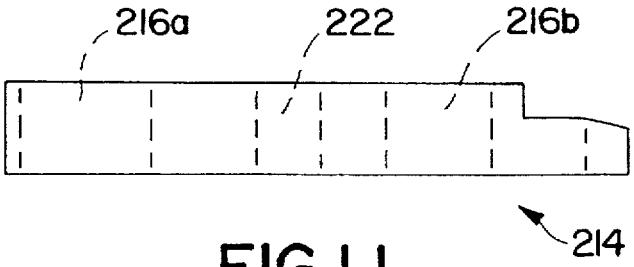
FIG. 11 is a side view of the quick release bar shown in FIG. 10.

Pressure plate 202 is securely mounted to lower bearing plate 204 by at least one and preferably by a plurality of quick release assemblies. The quick release assembly suitably includes locking pin 210, a slidable quick release bar 214 and a quick release bolt 218. Locking pin 210 includes a threaded lower end 211, and a knob 212 at its upper end. Threaded lower end 211 of pin 210 is configured to mate with a threaded bore in pressure plate 202, whereas knob 212 is configured to mate with slidable quick release bar 214, which is attached to a top planar surface of lower bearing plate 204 by fasteners 215*a*, 215*b* via bores 216*a*, 216*b* (FIGS. 10–11). Quick release bolt 218 employs a knob 219 on a top end, a cam 221 on the bottom end, and a shaft 220 disposed therebetween (FIGS. 8–9). Cam 221 of bolt 218 is configured to operatively engage an oval shaped bore 222 formed in release bar 214. Thus, when top knob 219 of bolt 218 is rotated, the wide portion of cam 221 engages the side wall of oval bore 222, causing release bar 214 to slide back and forth along the top planar surface of lower bearing plate 204, thereby engaging and disengaging knob 212 of pin 210.

In accordance with a preferred embodiment of the invention, three quick release assemblies are used to attach pressure plate 202 to lower bearing plate 204 (for clarity, only one quick release assembly is depicted in FIGS. 4 and 6). However, any number of assemblies may be used. Moreover, any other suitable means of fastening pressure plate 202 to lower bearing plate 204 may be used, such as standard screw or bolt assemblies. In accordance with yet another embodiment of the invention, the lower bearing plate 204 and the pressure plate 202 may be the same piece of hardware.

With continued reference to FIGS. 4 and 6, pressure plate 202 includes a plurality of vacuum holes 223 for applying a suction force to the back portion of the workpiece. The suction force is sufficient to hold the workpiece securely against pressure plate 202. Any suitable number and orientation of vacuum holes may be utilized in the present invention, however, in accordance with the illustrated embodiment, four concentric circles of vacuum holes 223 are suitably spaced about pressure plate 202, and one vacuum hole 223 is suitably located at the center of pressure plate 202.

A plurality of O-rings 224 may be positioned between pressure plate 202 and lower bearing plate 204 to thereby create a plurality of separately sealed vacuum compartments. An exemplary vacuum ducting system is used to supply the vacuum to the sealed compartments and to vacuum holes 223. In accordance with this aspect of the present invention, the ducting system includes a vacuum source attachment seat 230, a first conduit 232, a first conduit interface 234, a tube 236, a second conduit interface 238, a second conduit 240, and a recess 242. Seat 230 suitably exhibits a substantially conical cross-section so that a vacuum source can be secured and sealed therein. In the illustrated embodiment, seat 230 is formed in a separate material, for example, a polyurethane material, and attached to a top portion of upper bearing plate 206 with fasteners 244. However, in accordance with a further embodiment of the invention, seat 230 may be machined into upper bearing plate 206 so that only one part is needed.

Seat 230 is in fluid communication with first conduit 232, which is formed in upper bearing plate 206. First and second interfaces 234, 238 and tube 236 connect the vacuum source and first conduit 232 to second conduit 240 and recess 242. Accordingly, one end of first interface 234 communicates with conduit 232 while the other end communicates with a first end of tube 236. Similarly, second interface 238 suitably communicates with the second end of tube 236 and second conduit 240, which is formed in lower bearing plate 204. Completing the ducting system, conduit 240 communicates with recess 242, which is formed in the bottom planar surface of lower bearing plate 204 and suitably communicates with vacuum holes 223.

A retainer ring 250 positioned around the outside of pressure plate 202 is suitably configured to prevent lateral movement of the wafer during the polishing process. In accordance with this aspect of the present invention, retainer ring 250 preferably includes a flange 252 which extends over the edge of the bottom planar surface of pressure plate 202 and is machined to a predetermined thickness. When carrier element 200 engages a wafer, the wafer resides on the bottom planar surface of pressure plate 202 within the periphery of flange 252. As the carrier element rotates and oscillates the wafer across the polishing pad, flange 252 substantially prevents the rotational forces from dislodging the wafer from the bottom surface of the pressure plate.

In accordance with a preferred embodiment of the invention, retainer ring 250 snaps onto pressure plate 202 and is secured thereto by a frictional interface created between retainer ring 250 and an O-ring 254 suitably located around the outer surface of pressure plate 202. Thus, when retainer ring 250 is positioned about the outer periphery of pressure plate 202, the frictional interface prevents retainer ring 250 from sliding free from pressure plate 202.

With continued reference to FIGS. 4 and 6, a damping or gimbal effect is created in carrier element 200 by allowing pressure plate 202 and lower bearing plate 204 to move freely and float with respect to upper bearing plate 206. In accordance with this aspect of the present invention, upper bearing plate 206 is securely attached to a shaft 140 (see FIG. 3) which is part of multi-head transport apparatus 122. Multi-head transport apparatus 122 and shaft 140 are suitably configured to apply a downward axial force or pressure on carrier element 200 during the polishing process. Accordingly, upper bearing plate 206 is preferably secured to shaft 140 by a plurality of locking pins 256 which are configured to securely engage and lock into corresponding locking holes (not shown) on shaft 140. In this manner, carrier element 200 may be quickly released from shaft 140 by twisting carrier element 200 with respect to shaft 140 until locking pins 256 release from the locking holes on the shaft. Locking pins 256 may be secured to upper bearing plate 206 by any suitable fastening assembly. In accordance with a preferred embodiment, a threaded post 260 and a nut 258 are used. Although the illustrated embodiment is shown using the exemplary locking pins 256 to attach upper bearing plate 206 to shaft 140, it should be noted that carrier element 200 may be attached to shaft 140 by any other suitable attachment means, such as a standard nut and bolt assembly.

Surrounding lower and upper bearing plates 204 and 206, respectively, is a protective covering 208, which is attached to upper bearing plate 206 by a plurality of fasteners 262. Typically, covering 208 is made of a hard anodized steel material, however, any suitable protective material may be used.

The damping or bearing assemblies currently known in the art generally have high gimbal points (relative to the polishing surface), which can cause excessive edge polishing of the workpieces. Accordingly, the air bearing and spring bearing designs of the present invention are improvements over the bearing assemblies currently known in the art. In particular, the air bearing embodiment of the present invention has a gimbal point slightly above the top surface of the wafer. This relatively low gimbal point virtually eliminates front edge diving of carrier element 200. In addition, the air bearing of the present invention creates a low frictional interface between the upper and lower plates 206 and 204, allowing a free floating motion of the plates and providing a uniform pressure transfer to pressure plate 202.

Referring now to FIG. 4, the air bearing assembly suitably employs a semi-spherical hub or bushing 270 fixedly attached to lower bearing plate 204, and a corresponding seat 272 formed in upper bearing plate 206. An air inlet structure, which utilizes seat 230, a conduit 274 and a plurality of air holes 276 (preferably about 9), communicates with seat 272 to supply air to the gap formed between seat 272 and bushing 270. The air bearing assembly of the present invention is suitably configured such that the air pressure supplied to the air bearing creates an air pressure force between bushing 270 and seat 272 equal to or greater than the downward force placed on carrier element 200 by the multi-head transport apparatus. For example, if the transport apparatus is applying 400 pounds of pressure to carrier element 200, the air bearing preferably has a force of at least 400 pounds between bushing 270 and seat 272. By adjusting the air pressure between bushing 270 and seat 272, the amount of load the bearing can withstand can be altered. Also, by utilizing a plurality of air holes 276 disposed about seat 276, a more uniform distribution of air is provided to the gap between seat 272 and bushing 270 creating a more balanced air bearing.

While the illustrated embodiment shows the air inlet structure utilizing seat 230, conduit 274 and air hole 276, it should be noted that any suitable air inlet structure may be used. For example, the air inlet interface may be separate from seat 230, or it may be located on the side of the carrier. Moreover, the carrier may utilize only one air hole for supplying air to the gap of the air bearing.

Figure 5:
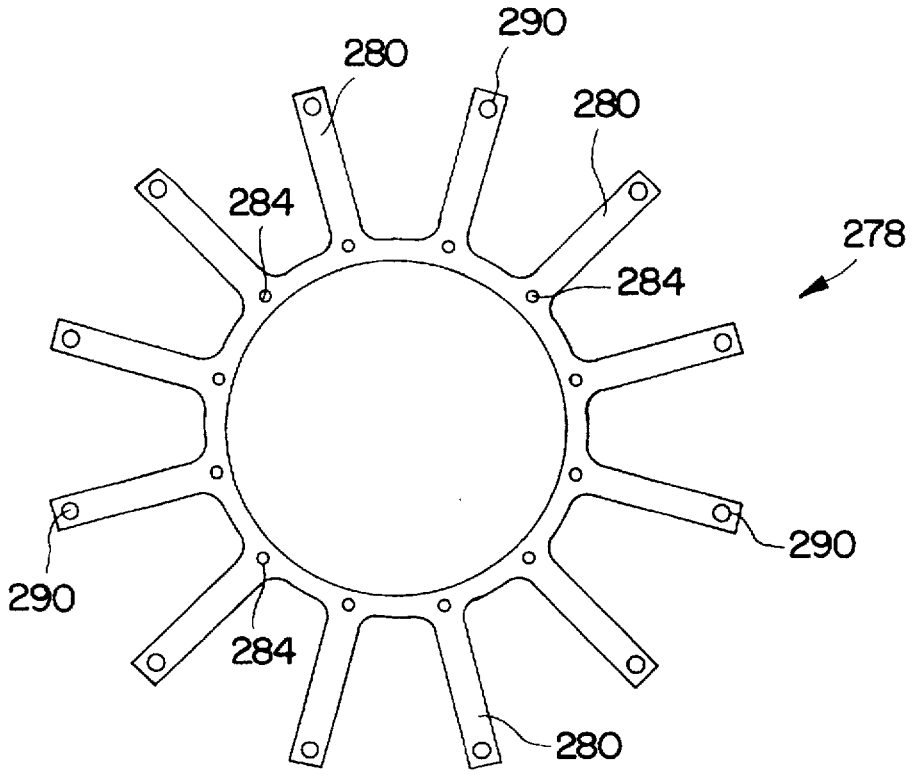
FIG. 5 is a top view of an exemplary metal diaphragm which acts as a flexure spring in the semiconductor wafer carrier element shown in FIG. 4.

The preferred embodiment of the air bearing assembly further includes a flexure spring 278 having a plurality of flexible fingers 280 (see FIG. 5). Flexure spring 278 is preferably attached to upper bearing plate 206 by a plurality of fasteners 282 which pass through holes 284 in spring 278 and into plate 206. The outer most part of fingers 280 are secured between an outer ring assembly 286 and lower bearing plate 204. A plurality of screws 288 secure fingers 280 of spring 278 between ring assembly 286 and plate 204 via holes 290 in the fingers and corresponding bores in ring 286 and plate 204. Ring assembly 286 further includes a flange 292 which overlaps with a similar flange 294 on upper bearing plate 206. The communication of overlapping flanges 292 and 294 limits the amount of movement between upper bearing plate 206 and lower bearing plate 204, thus, limiting the total amount of damping or gimbal.

During operation of the air bearing assembly, air pressure is provided to the gap between seat 272 and bushing 270 via conduit 276. The air pressure provided to the air bearing creates a force between upper bearing plate 206 and lower bearing plate 204 equal to or greater than the downward force on the carrier element. As the carrier element rotates and oscillates over the polishing pad, the air bearing assembly allows pressure plate 202 and lower bearing plate 204 to float freely with respect to upper bearing plate 206. If the carrier encounters an imperfection on the polishing pad, pressure plate 202 and lower bearing plate 204 will move or float with the imperfection thus maintaining a uniform axial pressure on the wafer. Additionally, flexure spring 278 adds a resistive force between the upper and lower bearing plates 206 and 204, thus, returning lower plate 202 and bearing plate 204 back to their original position after deflection.

Referring now to FIG. 6, an alternate embodiment utilizing a spring bearing is illustrated. The spring bearing assembly suitably includes a plurality of first springs 300 and the same number of corresponding second springs 302 positioned beneath and axially aligned with first springs 300. For clarity, only one combination of first and second springs 300, 302 is shown in FIG. 6. Any number of springs 300, 302 may be used, however, in accordance with the preferred embodiment, six pairs of springs 300, 302 are equally positioned in a circular orientation about upper bearing plate 206 and lower bearing plate 204. Springs 300 are suitably positioned within recesses 304 in upper bearing plate 206. Similarly, springs 302 are positioned between upper bearing plate 206 and lower bearing plate 204 within recesses 306 in the lower plate and recesses 308 in the upper plate. A fastener 310 preferably passes through the center of springs 300, 302 and recesses 304, 306, 308, holding the springs in operative engagement with bearing plates 204, 206. Preferably, fastener 310 has a threaded lower end configured to communicate with a threaded bore in lower bearing plate 204.

In accordance with the preferred embodiment, springs 300, 302 are partially compressed within their respective recesses, thus, creating a tension between upper bearing plate 206 and lower bearing plate 204. Springs 300, 302 may function to suitably bias lower plate 202 and bearing plate 204 and to provide damping during operation.

Figure 7:
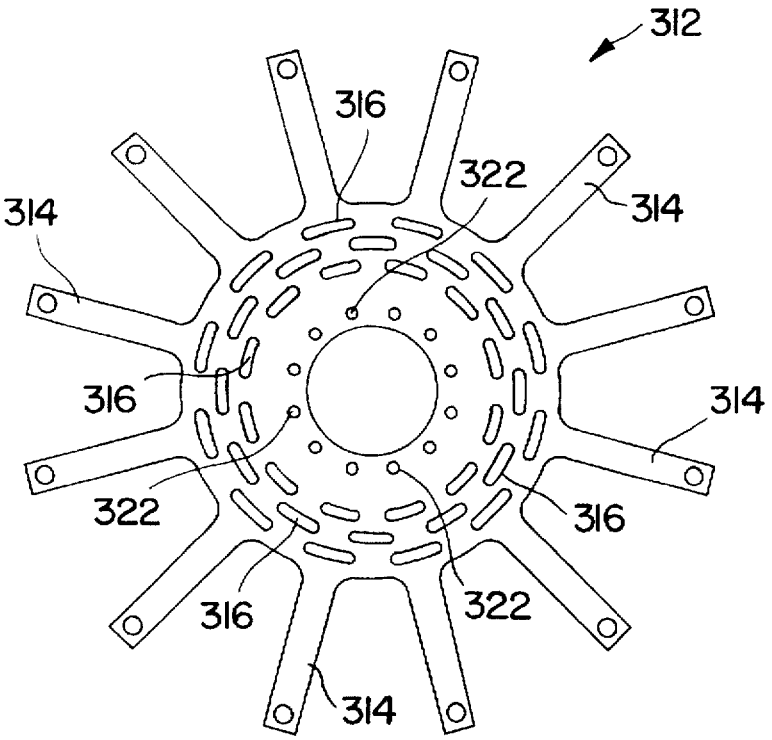
FIG. 7 is a top view of a perforated metal diaphragm which acts as a flexure spring in the semiconductor wafer carrier element shown in FIG. 6.

Further, the spring bearing assembly preferably includes a perforated flexure spring 312. Flexure spring 312 is shown in greater detail in FIG. 7. Like flexure spring 278 of the air bearing assembly, flexure spring 312 includes a plurality of finger portions 314 secured between outer ring assembly 286 and lower bearing plate 204 with screws 288. Flexure spring 312 further includes a plurality of perforated holes 316 adapted to enhance the flexibility of spring 312. The inner portion of spring 312 is secured between upper bearing plate 206 and a mounting ring 320 by a plurality of fasteners 318.

Fasteners 318 preferably engage suitable bores formed in ring 320 and plate 206, and holes 322 formed in spring 312.

Like the air bearing assembly, outer ring assembly 286 and upper bearing plate 206 of the spring bearing embodiment include flanges 292 and 294, respectively, which overlap and limit the amount of movement between upper and lower bearing plates 206, 204.

As carrier element 200 rotates and oscillates over the polishing pad, the spring assembly allows pressure plate 202 and lower bearing plate 204 to float or move freely with respect to upper bearing plate 206. Like the air bearing assembly, if carrier element 200 encounters an imperfection on the polishing pad, then pressure plate 202 and lower bearing plate 204 will move or float with the imperfection, thus maintaining a uniform axial pressure on the wafer. Springs 300, 302, and flexure spring 312, add a resistive force between upper and lower bearing plates 206, 204 that returns lower plate 202 and bearing plate 204 back to their original position after deflection.

It will be understood that the foregoing description is of preferred exemplary embodiments of the invention and that the invention is not limited to the specific forms shown or described herein. Various modifications may be made in the design, arrangement, and type of elements disclosed herein without departing from the scope of the invention as expressed in the appended claims.

What is claimed is:

1. An apparatus for engaging a workpiece against a polishing surface during polishing of the workpiece, comprising:

a drive shaft;

a lower plate member for securely holding the workpiece during the polishing process, said lower plate member having a hub disposed on a top planar surface thereof;

an upper plate member connected to said drive shaft, said upper plate member having a seat disposed on a bottom planar surface thereof, wherein said hub is configured to fit within said seat, forming an air bearing between said lower plate member and said upper plate member;

a means for supplying air to said air bearing; and a flexure spring disposed between and connected to said lower plate member and said upper plate member.

2. The apparatus as defined in claim 1, wherein said lower plate member further comprises a plurality of vacuum holes formed in a bottom planar surface thereof, said vacuum holes being connected to a vacuum source, such that a vacuum pressure caused by said vacuum source holds the workpiece against the bottom planar surface of said lower plate member.

3. The apparatus as defined in claim 1, further comprising a retainer ring positioned about an outer edge surface of said lower plate member, said retainer ring including a flange which extends onto the bottom planar surface of said lower plate member.

4. The apparatus as defined in claim 1, wherein said lower plate member further comprises a detachable pressure plate.

5. The apparatus as defined in claim 4, wherein said detachable pressure plate further comprises a plurality of vacuum holes formed in a bottom planar surface thereof, said vacuum holes being connected to a vacuum source, such that a vacuum pressure caused by said vacuum source holds the workpiece against the bottom planar surface of said pressure plate.

6. The apparatus as defined in claim 4, further comprising a retainer ring positioned about an outer edge surface of said pressure plate, said retainer ring including a flange which extends onto a bottom planar surface of said pressure plate.

7. The apparatus as defined in claim 4, wherein said detachable pressure plate is connected to said lower plate member by at least one quick release apparatus comprising:

a locking pin secured to said pressure plate and configured to fit through a bore formed in said lower plate member;

a means for securely engaging said locking pin, said engaging means being slidably attached to an upper planar surface of said lower plate member; and a means for moving said engaging means into and out of secured engagement with said locking pin, said moving means being operatively connected to said engaging means.

8. An apparatus for engaging a workpiece against a polishing surface during polishing of the workpiece, comprising:

a drive shaft;

an upper plate member connected to said drive shaft, said upper plate member having a number of first recesses formed in a top portion thereof and the same number of second recesses formed in a bottom portion thereof, said first and second recesses being axially aligned within said upper plate member;

a lower plate member for securely holding the workpiece during polishing, said lower plate member having a plurality of third recesses formed in a top portion thereof, said third recesses being axially aligned with said first and second recesses;

a plurality of first springs disposed within said first recesses;

a plurality of second springs disposed between said upper plate member and said lower plate member, wherein a top portion of said second springs are positioned within said second recesses and a bottom portion of said second springs are positioned within said third recesses;

a means for holding said first springs within said first recesses and said second springs within said second and third recesses; and a flexure spring disposed between and connected to said upper plate member and said lower plate member.

9. The apparatus as defined in claim 8, wherein six said first and second springs are used.

10. The apparatus as defined in claim 8, wherein said lower plate member further comprises a plurality of vacuum holes formed in a bottom planar surface thereof, said vacuum holes being connected to a vacuum source, such that a vacuum pressure caused by said vacuum source holds the workpiece against said bottom planar surface.

11. The apparatus as defined in claim 8, wherein said lower plate member further comprises a retainer ring positioned about an outer edge surface of said lower plate member, said retainer ring including a flange which extends onto a bottom planar surface of said lower plate member.

12. The apparatus as defined in claim 8, wherein said lower plate member further comprises a detachable pressure plate.

13. The apparatus as defined in claim 12, wherein said detachable pressure plate further comprises a plurality of vacuum holes formed in a bottom planar surface thereof, said vacuum holes being connected to a vacuum source, such that a vacuum pressure caused by said vacuum source holds the workpiece against said bottom planar surface.

14. The apparatus as defined in claim 12, wherein said detachable pressure plate further comprises a retainer ring positioned about an outer edge surface of said pressure plate, said retainer ring including a flange which extends onto a bottom planar surface of said pressure plate.

15. The apparatus as defined in claim 12, wherein said detachable pressure plate is connected to said lower plate member by at least one quick release apparatus comprising:

a locking pin secured to said pressure plate and configured to fit through a bore formed in said lower plate member;

a means for securely engaging said locking pin, said engaging means being slidably attached to an upper planar surface of said lower plate member; and a means for moving said engaging means into and out of secured engagement with said locking pin, said moving means being operatively connected to said engaging means.

* * * * *

UNITED STATES PATENT AND TRADEMARK OFFICE

CERTIFICATE OF CORRECTION

PATENT NO. : 5,791,978

DATED : August 11,1998

INVENTOR(S) : Cesna et al

It is certified that error appears in the above-identified patent and that said Letters Patent is hereby corrected as shown below:

On the title page: Item [56] insert the following;

FOREIGN PATENT DOCUMENTS

| | | DOCUMENT NUMBER | | | | | | | PUBLICATION DATE | COUNTRY OR PATENT OFFICE | CLASS | SUBCLASS | TRANSLATION YES | TRANSLATION NO |
|---|---|---|---|---|---|---|---|---|---|---|---|---|---|---|
| | | 6 | 0 | 1 | 0 | 9 | 8 | 63 | 7/25/85 | Japan | | | | |
| | | 2- | 2 | 8 | 4 | 8 | 6 | 8 | 11/22/90 | Japan | | | | |

OTHER DOCUMENTS

| | | |
|---|---|---|
| | | Microfilm of the spec. and drawings annexed to written appln. JP 62296/1988, |
| | | November 21, 1989, line 14, pg. 8 to line 5, pg. 9 |
| | | Microfilm of the spec. and drawings annexed to written appln. JP 22807/1973, |
| | | October 29, 1974, line 21, pg. 2 to line 9, pg. 3 |
| | | Microfilm of the spec. and drawings annexed to written appln. JP 94064/1990, |
| | | July 26, 1990, line 3, pg. 5 to line 16, pg. 7 |

Signed and Sealed this

Fourth Day of May, 1999

*Attest:*

*Attesting Officer*

Q. TODD DICKINSON

*Acting Commissioner of Patents and Trademarks*